US010413001B2

(12) United States Patent
Carnes

(10) Patent No.: US 10,413,001 B2
(45) Date of Patent: Sep. 17, 2019

(54) HAND COVERING WITH IMPROVED UTILITY

(71) Applicant: Ruthie Mae Carnes, Cordova, TN (US)

(72) Inventor: Ruthie Mae Carnes, Cordova, TN (US)

(73) Assignee: Ruthie Mae Carnes, Cordova, TN (US)

( * ) Notice: Subject to any disclaimer, the term of this patent is extended or adjusted under 35 U.S.C. 154(b) by 233 days.

(21) Appl. No.: 14/982,320

(22) Filed: Dec. 29, 2015

(65) Prior Publication Data

US 2016/0270461 A1 Sep. 22, 2016

Related U.S. Application Data

(60) Provisional application No. 62/118,076, filed on Feb. 19, 2015.

(51) Int. Cl.

| | |
|---|---|
| ***A41D 19/01*** | (2006.01) |
| ***A41D 19/00*** | (2006.01) |
| ***A41D 19/02*** | (2006.01) |
| ***A41D 13/08*** | (2006.01) |

(52) U.S. Cl.

CPC ..... *A41D 19/0013* (2013.01); *A41D 13/081* (2013.01); *A41D 19/02* (2013.01); *A41D 19/01* (2013.01)

(58) Field of Classification Search

CPC .... A41D 19/0013; A41D 19/02; A41D 19/01; A41D 13/081

USPC ..... 40/586; 2/158, 199; D2/614, 417, 613, D2/612

See application file for complete search history.

(56) References Cited

U.S. PATENT DOCUMENTS

| | | | | | |
|---|---|---|---|---|---|
| 1,275,837 | A | * | 8/1918 | Biggs | A41D 19/01 2/158 |
| 1,365,526 | A | * | 1/1921 | Milkes | A41D 27/10 2/111 |
| 2,274,335 | A | * | 2/1942 | Kennedy | A41D 19/01 2/158 |
| 3,299,441 | A | * | 1/1967 | Slimovitz | A41D 19/0017 2/158 |
| 3,403,408 | A | * | 10/1968 | Helfer | A41D 19/0017 2/158 |
| 4,193,135 | A | * | 3/1980 | Rhee | A41D 13/081 2/162 |
| 4,486,975 | A | * | 12/1984 | Harreld | A63H 33/00 2/158 |
| 5,432,991 | A | * | 7/1995 | Godleski | A63H 3/14 116/306 |

(Continued)

OTHER PUBLICATIONS

Nov. 17, 2017 letter from Gunn, Lee & Cave, P.C. asserting a third party submission of prior art was ma for the subject application.

(Continued)

*Primary Examiner* — Timothy K Trieu

(74) *Attorney, Agent, or Firm* — Ruthie Mae Carnes

(57) ABSTRACT

A covering designed to fit over all or part of a person's hand which contains one or more openings is provided. The opening(s) allow a person to use their thumb and/or fingers while still wearing the covering. A method of making the covering and tools for making the covering are also provided.

4 Claims, 8 Drawing Sheets

(56) References Cited

U.S. PATENT DOCUMENTS

| | | | | |
|---|---|---|---|---|
| 6,581,211 | B1 * | 6/2003 | Golden | A41D 19/01 2/158 |
| 6,612,056 | B1 * | 9/2003 | Thomas, II | G09F 21/02 40/586 |
| 2003/0074819 | A1 * | 4/2003 | Corona | G09F 21/02 40/586 |
| 2007/0118963 | A1 * | 5/2007 | Snyder | A61H 7/003 2/158 |
| 2012/0311766 | A1 * | 12/2012 | Clark | A41D 19/01 2/158 |
| 2013/0081312 | A1 * | 4/2013 | McFadden | G09F 21/026 40/586 |

OTHER PUBLICATIONS

Picture of foam finger advertisement purported to have been published on Jan. 6, 2010 accompanying the Nov. 17, 2017 letter from Gunn, Lee & Cave.

* cited by examiner

HAND COVERING WITH IMPROVED UTILITY

CROSS REFERENCE TO RELATED APPLICATIONS

This application claims the benefit of priority from U.S. Provisional Application No. 62/118,076 filed Feb. 19, 2015.

BACKGROUND

A common sight at sporting events, concerts and other venues which draw crowds is the foam hand or foam finger. These items are designed to cover a user's hand and typically convey a message (e.g. "We're No. 1!" etc.) and/or support for a particular person, group or team to the rest of the audience.

Unfortunately, while wearing a foam hand or other similar type of covering a user's thumb and fingers are rendered essentially useless. This is because these coverings envelope the wearer's entire hand and, unlike a glove, enclose the thumb and fingers in a single compartment with no extensions within the compartment for each individual finger or thumb. In particular, it is not possible to use the thumb and fingers to grasp and manipulate an item such as a beverage can, bag of popcorn, snack, etc. while wearing these coverings.

SUMMARY OF THE INVENTION

In one aspect the invention is drawn to a covering designed to fit over a person's hand which contains one or more openings. The opening(s) allow a person to use their thumb and/or fingers while still wearing the covering. In another aspect the covering only covers the back of a person's hand and is secured to the person at the wrist.

Another aspect of the invention provides a method for making a covering designed to fit over a user's hand with the fingers and thumb fitting together in a single compartment more user friendly. According to this method, one or more openings are formed on the palm side of the covering to allow a person to use their thumb and/or fingers while still wearing the covering.

Yet another aspect of the invention provides a tool to aid in the forming of openings in the covering which will have the desired shape and configuration.

DESCRIPTION OF THE FIGURES

FIG. 11. This figure shows the solid back section of the covering of FIG. 10. This covering is preferably about 16-18 inches long, 4-6 inches wide and 1-3 inches thick.

FIG. 12. This figure shows the middle section of the covering of FIG. 10. It includes a large opening (18) that creates the opening for the hand when all three sections are combined to form the entire covering.

FIG. 13. This figure shows the front section of the covering of FIG. 10 with finger slot (12), thumb hole (14) and palm bridge (16).

DETAILED DESCRIPTION OF THE INVENTION

Figure 1:
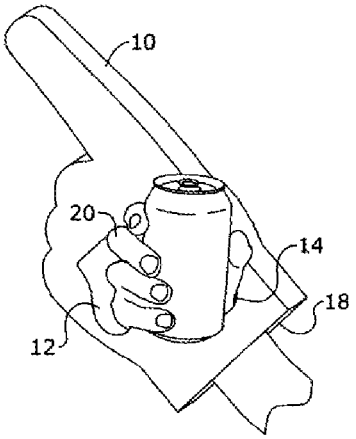
FIG. 1. This figure shows an embodiment of the covering of the invention (labeled 10) in use with the wearer's right hand inserted into the covering through the opening at the bottom of the covering (labeled 18). The wearer's thumb and fingers (labeled 20) can be seen grasping a can through a thumb opening (labeled 14) and an opening for the fingers (labeled 12).
Figure 2:
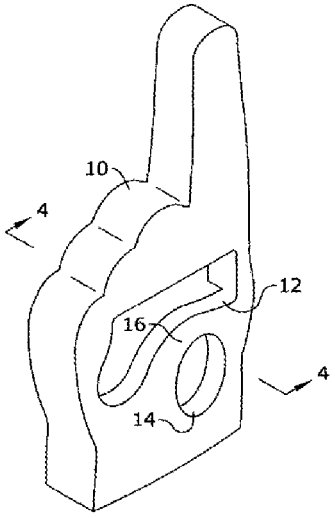
FIG. 2. This figure shows a right side, front and top leaning view of the same embodiment of the invention shown in FIG. 1 that is not in use. From this perspective one can see the bridge (labeled 16) that separates the thumb opening (14) from the opening for the fingers (12).
Figure 3:
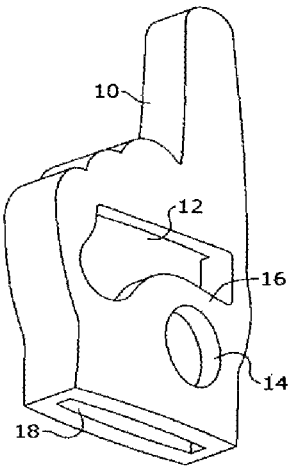
FIG. 3. This figure shows a right side bottom leaning view of the same embodiment of the invention shown in FIG. 1 that is not in use. From this perspective one can more clearly see the opening at the bottom of the covering (18) which can accommodate insertion of the wearer's entire hand.
Figure 4:
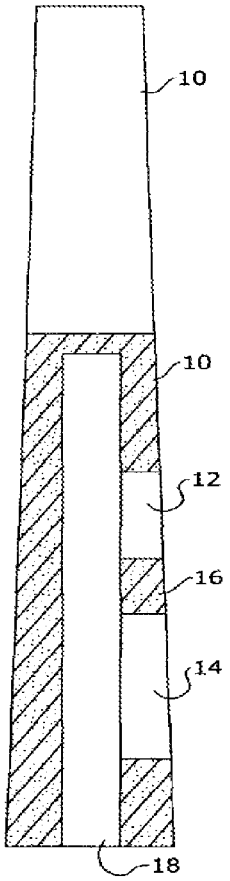
FIG. 4. This figure shows a left side view of the covering taken along line axis 4-4 in FIG. 2. In this embodiment the openings for the thumb (14) and fingers (12) extend only through the front (palm) side of the covering.
Figure 5:
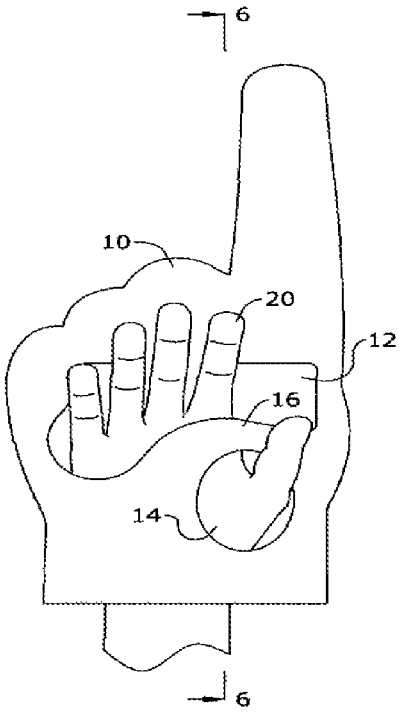
FIG. 5. This figure shows a front view of the same embodiment of the invention shown in FIG. 1 showing a hand with fingers and thumb extending from the palm bridge but not otherwise in use.
Figure 6:
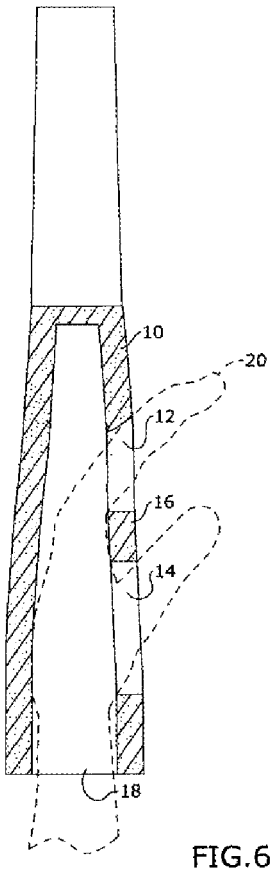
FIG. 6. This figure shows another side view of the covering similar to section 4 except that it is in use with the wearer's left hand (20) illustrated in dotted lines.
Figure 7:
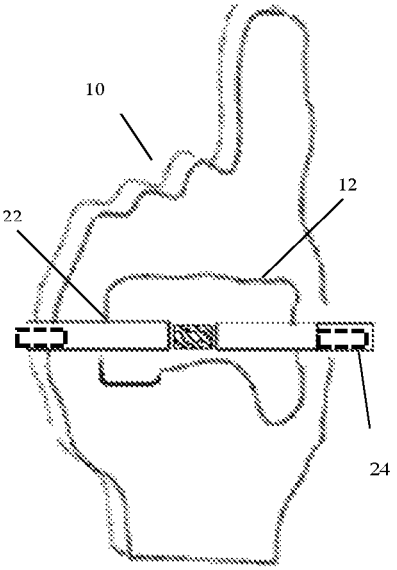
FIG. 7. This figure shows a right hand frontal view of an embodiment of the invention having a palm strap (22 and 24) used in a single opening (12) with each end of the strap having a velcro tac (shown in dotted lines) to fasten the ends of the strap to each other. Preferably these velcro attachments are approx. 1/10 inches thick. Both straps go through two slots in the back side of the covering (10). The single opening exposes the wearer's entire hand, fingers and thumb with the strap anchoring the wearer's hand to the covering.
Figure 8:
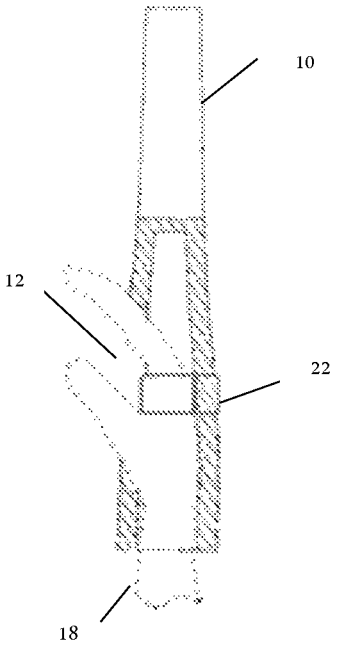
FIG. 8. This figure shows a cross sectional view of an embodiment of the covering (10) similar to FIG. 6 but with a single opening and a palm strap (22) instead of a bridge. The wearer's hand is shown in dotted lines. The strap may preferably be approx. 8-10 inches long by 1 inch wide. The strap can be used around right or left hand through opening (12).
Figure 9:
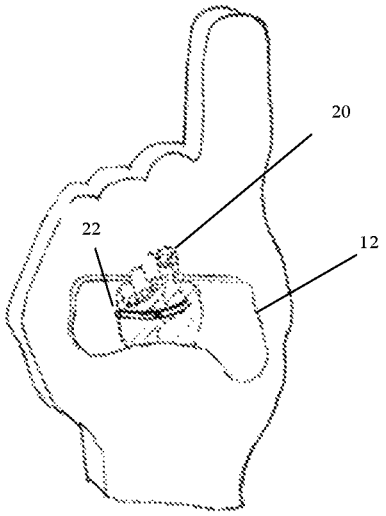
FIG. 9. This figure shows a strap (22) around the wearer's right hand (20), which extends through a single opening (12) in the palm side of this embodiment of the covering. The strap (22) is anchored around the back of the covering through slots made for this purpose (not shown). See FIG. 8.
Figure 10:
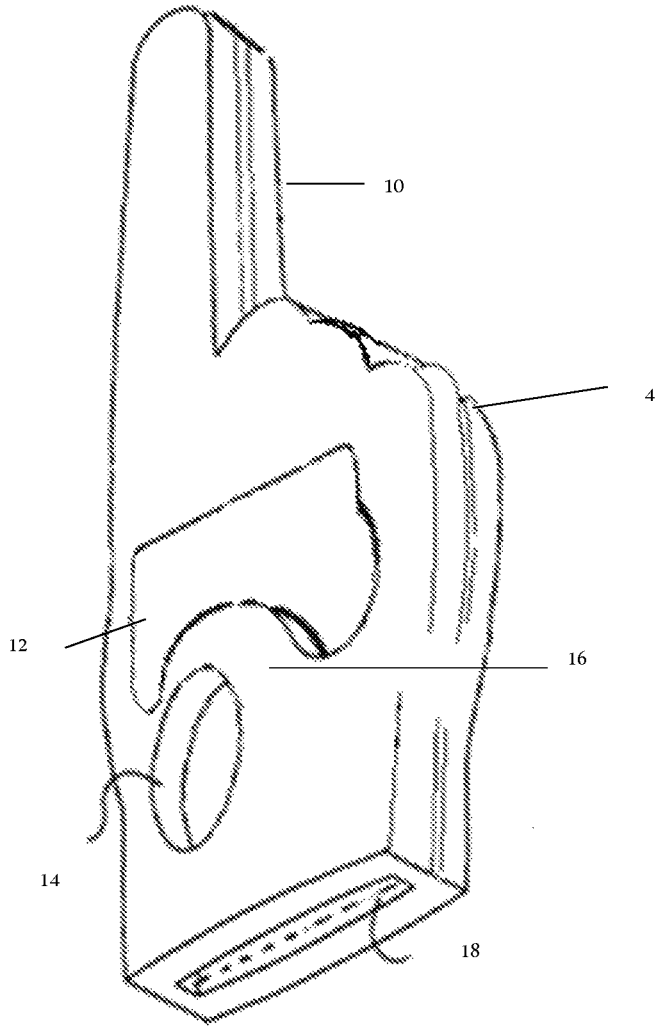
FIG. 10. This figure shows a covering of the invention put together as front, middle and back longitudinal sections. The front section has the finger hole (12), bridge (16) and thumb hole (14). The middle section (4) creates the opening (18) at the bottom of the covering. The back section (labeled 10) is solid in this embodiment.

In one aspect the present invention is drawn to a covering designed to fit over a person's hand that allows a wearer to use their thumb and/or fingers outside of the covering. A unique aspect of the covering is the inclusion of one or more openings on one side (the palm side) or both sides (palm and back) that allow such use.

Aside from the aforementioned opening(s), the covering of the invention is designed to envelope a person's entire hand rather than conform to the contours of their thumb and fingers like a glove. This lack of conformity, along with other features of the covering such as its size and the thickness of the material used to make it, would keep a wearer from effectively using their thumb and/or fingers if not for the aforementioned opening(s).

The covering may have any shape or size, but is larger than the wearer's hand. The covering may be slightly larger than the wearer's hand or, preferably at least 1.5 times larger than the wearer's hand, more preferably at least twice as large as the wearer's hand. Preferred embodiment's include oversize versions of familiar shapes, like a hand or a hand in the shape of a first or a hand with an extended finger as depicted in the figures and in UltimateHand™ foam hands, as well as symbols representing a team, logo, mascot, sports figure, etc. or chant (e.g. the letter D together with a depiction of a fence to connote the chant "Defense!"), a pair of angle wings bearing a slogan, "You inspire me", a large circle like a clock, that says "It's Time" or a variety of over-sized sporting paraphernalia that covers over the hand where the fingers and thumb can protrude out from the inside to the outside to give support to the user.

The covering is also not limited to any type or thickness of material, but using environmentally friendly "green" and/or biodegradable materials is preferred. Since the wearer does not have to attempt to use their thumb and fingers through the material of the covering, the thickness or rigidity of the material is not a significant concern. The material should generally be firm enough to maintain its basic form when the thumb and/or fingers are in use outside of the covering.

The opening(s) can be any shape and size to accommodate use of the thumb and/or fingers outside of the covering. The opening may extend through the front (palm) and back side of the covering or it may extend only through the front (palm) side of the covering. Where the opening(s) extend entirely through the covering (through both the front and back sides) the covering can be used with either hand.

The covering may have a single opening that allows use of the thumb and/or one or more fingers. When a single opening is employed to allow use of the thumb and fingers, the covering may include a strap affixed to the covering designed to run across the palm and hold the hand in place. The strap may be fixed in size with flexible material to hold hands of various sizes or it may be adjustable in length for the same purpose.

In a preferred configuration the covering has two openings; one which allows use of the fingers and one which allows use of the thumb. The two openings are separated by a strip of material designated herein as the "bridge". The bridge gives the wearer some control of the covering while the thumb and fingers are being used, much like the strap mentioned in the preceding paragraph. The bridge may consist of the same material as the rest of the covering or a different material. When a different material is used it is preferably firmer than the rest of the material of the covering in order to provide better control of the covering.

A particularly preferred configuration of the openings is shown in the figures. In this configuration the openings are contoured to allow the fingers and thumb to be used outside of the covering while maintaining control of the covering.

In this preferred configuration, two openings are separated by a bridge ("palm bridge") with the top opening designed to accommodate the fingers and the bottom opening designed to accommodate the thumb.

The top opening is approx. 4, 4½-5 inches wide with a straight edge at the top and a curved bottom edge to accommodate the natural curvature of the base of the fingers with a height of 2-2½ inches in the area accommodating the first through third fingers extending to a height of 5 inches to accommodate the little finger.

The palm bridge is approx. 1-1½ inches in height following the circle of the thumb opening, which is approx. 2-2¼ inches in diameter.

The openings of the covering may be covered when not in use. In this embodiment the opening(s) may be covered with a piece of the same material as the rest of the covering that is the same shape as the opening(s). These pieces can then be popped out when the wearer wants to use the openings.

Alternatively, the pieces may remain attached to the covering at one edge so they operate as flaps the wearer can push their thumb and/or fingers through. In this embodiment the pieces may remain attached at one edge with a hinge that can be used to keep the pieces in a desired open or closed position.

Figure 15:
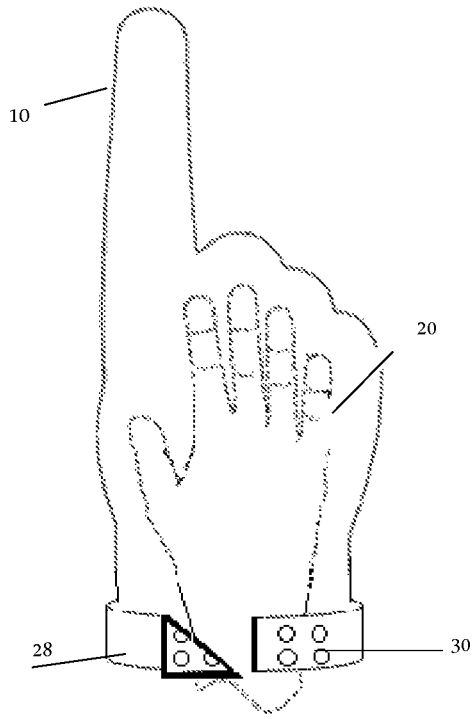
FIG. 15. This figure shows another embodiment of the covering (10) which only covers the back of the wearer's left hand and is attached to the wearer's wrist by an adjustable strap (28). This figure shows the front side of the covering with snap adjustments visible (30). The wearer's hand is shown in dotted lines.
Figure 16:
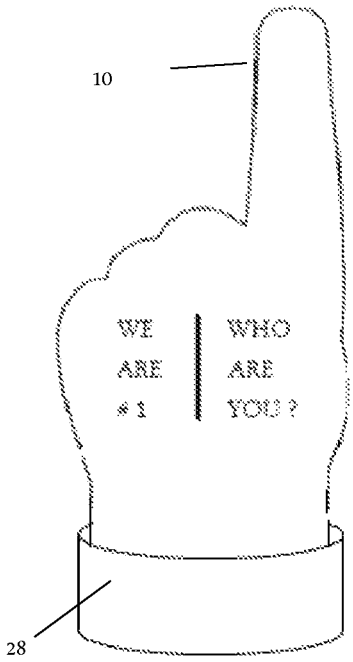
FIG. 16. This figure shows the opposite side of the covering (10) shown in FIG. 15. From this side the snap adjustments on the strap (28) and the wearer's hand are not visible.

The covering of the invention may also take a different form which only covers the back of a person's hand. In this form the covering is secured to the person at the wrist. The covering may be secured at the wrist with a band or flexible materials like a rubber band or with a strap that can be tightened around the wrist. For example, see FIGS. 15 and 16. In this form the covering may be larger or smaller than a wearer's hand, but is preferably at least as large as the back of the wearer's hand.

In another aspect a method for making the covering of the invention is provided. This method begins with a conventional covering such as a foam hand having no openings on the palm or back side. One or more openings are then formed on either the palm side of the covering only or completely through the covering.

The opening(s) may be formed using any tool capable of cutting through the material of the covering including but not limited to a knife, scissors, saw, box cutter, hot wire and mold press in the shape desired for the opening(s). A pattern in the shape of the desired opening(s) may be drawn into the covering manually or automatically to help guide cutting of the material.

A solid material (e.g. wood, metal, etc.) may be placed inside the compartment of the covering when forming the opening(s) to avoid cutting through to the back side of the covering, it may be glued, sewn, fused together or cut separately.

Figure 13:
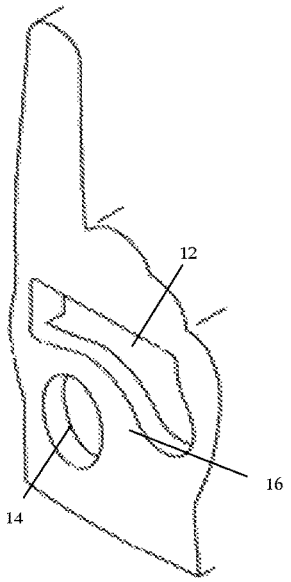
FIGS. 11, 12, and 13 show each section separately.
Figure 12:
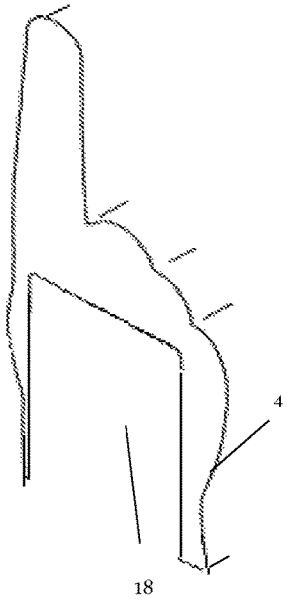
Figure 11:
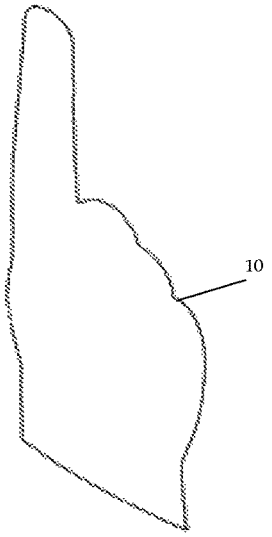
Figure 14:
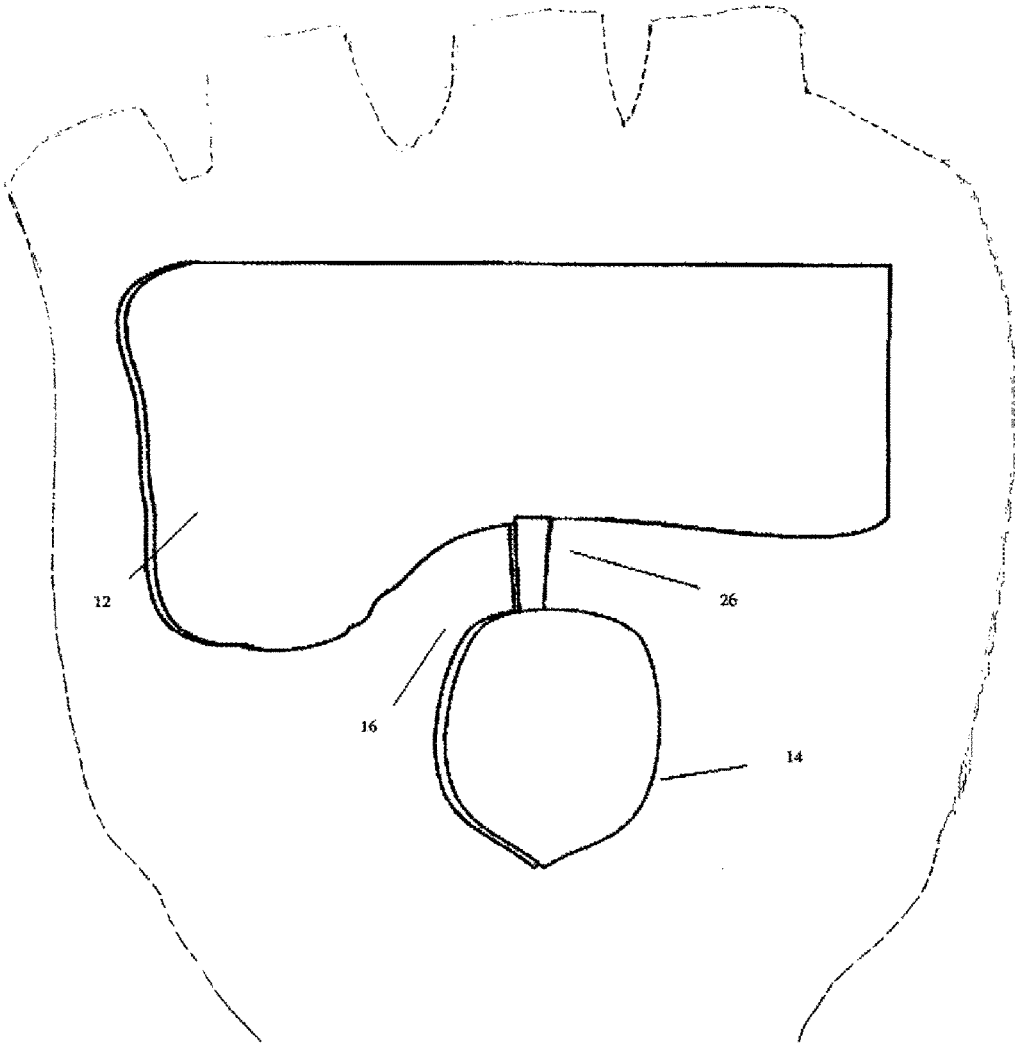
FIG. 14. This figure shows the manufactures metal mold or die to cut out the finger slot and thumb hole from a covering with a metal bracket (26) the device creates the images between the fingers (12) and thumb (14) to give support for repetitive designs to make the product. A metal bracket covers area for the bridge (labeled 16) the metal bracket is attached for assembly safety and to make the metal mold impressions of the items (12, 14 and 16). The metal pattern mold design has dual blade usage, designed to create desired image.

An alternative method comprises making the covering in longitudinal sections that are then glued, sewn or otherwise fused together to make the complete covering. Preferably three sections are used: one for the palm side of the covering, one for the middle and one for the back side (see FIGS. 10-13). For this method the back section (FIG. 11) is solid with no openings for a covering in which the opening is only intended to extend through the front (palm) side. The middle section (FIG. 12) provides a large opening that creates the opening for the entire hand when assembled with the front and back sections. The front section (FIG. 13) has the openings for the fingers and thumb as well as the bridge between these two openings. Yet another aspect of the invention provides a tool to aid in the forming of openings in the covering which will have the desired shape and configuration. For example, a metal cast designed to cut openings in the desired shape from the covering is provided (See FIG. 14).

All of the above U.S. patents, U.S. patent application publications, U.S. patent applications, foreign patents, foreign patent applications and non-patent publications referred to in this specification, including but not limited to U.S. patent application Ser. No. 62/118,076 filed Feb. 19, 2015 are incorporated herein by reference, in their entirety. All of references, patents, patent applications, etc. cited above, are incorporated herein in their entirety.

What is claimed is:

1. A covering designed to fit over a person's hand with the fingers, thumb and palm fitting together in a single compartment, wherein said covering comprises at least two opening sufficient to allow the person to position one or more fingers or thumb outside of said covering while wearing said covering, and further wherein said covering is configured at least 1.5 times larger than the person's hand;

wherein said at least two openings comprise a first opening for the thumb of said person and a second opening for the fingers of said person;

wherein the configuration of the openings allows a person to grip an object between their thumb and fingers while wearing said covering;

further having a first opening between 4 and 5 Inches wide and between 2 and 5 inches high to accommodate the person's fingers and a second opening in the shape of a circle between 2 and 2¼ Inches in diameter to accommodate the person's thumb, wherein the first opening and the second opening are separated by a palm bridge, between 1 and 1½ inches in height.

2. The covering of claim 1 wherein said at least two openings are only on the palm side of the covering.

3. The covering of claim 1 wherein said covering is made of material selected from the group consisting of foam, plastic, polyurethane, paper and fabric.

4. The covering of claim 1 wherein said covering is in the shape of an over-sized hand.

* * * * *